US005639383A

United States Patent [19]

Gajas Fuertes et al.

[11] Patent Number: 5,639,383

[45] Date of Patent: Jun. 17, 1997

[54] USED MINERAL MOTOR OIL ECOLOGICAL RECYCLING PROCEDURE

[75] Inventors: Carlos Gajas Fuertes; Miguel Balada Subirats, both of Barcelona, Spain

[73] Assignee: Ralfer, S.L., Barcelona, Spain

[21] Appl. No.: 230,834

[22] Filed: Apr. 21, 1994

[30] Foreign Application Priority Data

Apr. 28, 1993 [ES] Spain ..... 9300893
Jan. 17, 1994 [ES] Spain ..... 9400078

[51] Int. Cl.[6] ..... C08L 95/00; C10G 7/00; C10G 9/00; C10G 33/06

[52] U.S. Cl. ..... 210/774; 106/277; 203/12; 208/179; 208/181; 208/184; 208/44; 210/776; 210/787; 210/806; 210/909; 210/912

[58] Field of Search ..... 203/12; 208/179, 208/181, 184, 186, 38, 44, 187; 210/767, 770, 774, 787, 806, 9, 2, 913, 914, 909; 106/277, 278, 279; 422/70; 436/126

[56] References Cited

U.S. PATENT DOCUMENTS

| | | | |
|---|---|---|---|
| 4,021,333 | 5/1977 | Habiby et al. | 208/179 |
| 4,053,401 | 10/1977 | Fukushima et al. | 210/912 |
| 4,211,576 | 7/1980 | Yan | 106/279 |
| 5,141,628 | 8/1992 | Martin et al. | 208/184 |

FOREIGN PATENT DOCUMENTS

| | | |
|---|---|---|
| 0 206 015 | 12/1986 | European Pat. Off. . |
| 0 300 284 | 1/1989 | European Pat. Off. . |
| 0 378 371 | 7/1990 | European Pat. Off. . |
| 0 380 384 | 8/1990 | European Pat. Off. . |
| 0 411 627 | 2/1991 | European Pat. Off. . |
| 0 422 315 | 4/1991 | European Pat. Off. . |
| 0 421 525 | 4/1991 | European Pat. Off. . |
| 2.228.817 | 12/1974 | France . |
| 2.288.127 | 5/1976 | France . |
| 34 46 174 | 6/1986 | Germany . |
| 276 504 | 2/1990 | Germany . |
| 276 505 | 2/1990 | Germany . |
| 426382 | 3/1974 | Spain . |
| 8201192 | 12/1980 | Spain . |
| 8500979 | 9/1983 | Spain . |
| 87/6764 | 5/1988 | Spain . |
| 8904172 | 12/1989 | Spain . |

*Primary Examiner*—David A. Reifsnyder
*Attorney, Agent, or Firm*—Jacobson, Price, Holman & Stern

[57] ABSTRACT

This procedure includes detecting and rejecting the used mineral motor oils containing polychlorinated biphenyls (PCB's) and/or polychlorinated triphenyls (PCT's) before filtering; before the decantation and/or distillation step, if necessary, submitting the used mineral motor oil to thermal shock treatment. In the recycling process, stabilizing the used mineral motor oils that normally contain heavy metals by adding to bitumen, using 0 to 15 percent of used mineral motor oil and a minimum of 85 percent bitumen for bituminous pavements and 1 to 20 percent of used mineral motor oils and a minimum of 80 percent bitumen for bitumen emulsions and paints. Also in the recycling process the used mineral motor oils are mixed with bitumen and paraffinic elastomers, stabilizing the heavy metals contained in the used mineral motor oils, getting usual bituminous pavements, self-draining bituminous pavements, sport pavements, etc. EPM EPDM or butyl rubber are used as paraffinic elastomers.

18 Claims, 1 Drawing Sheet

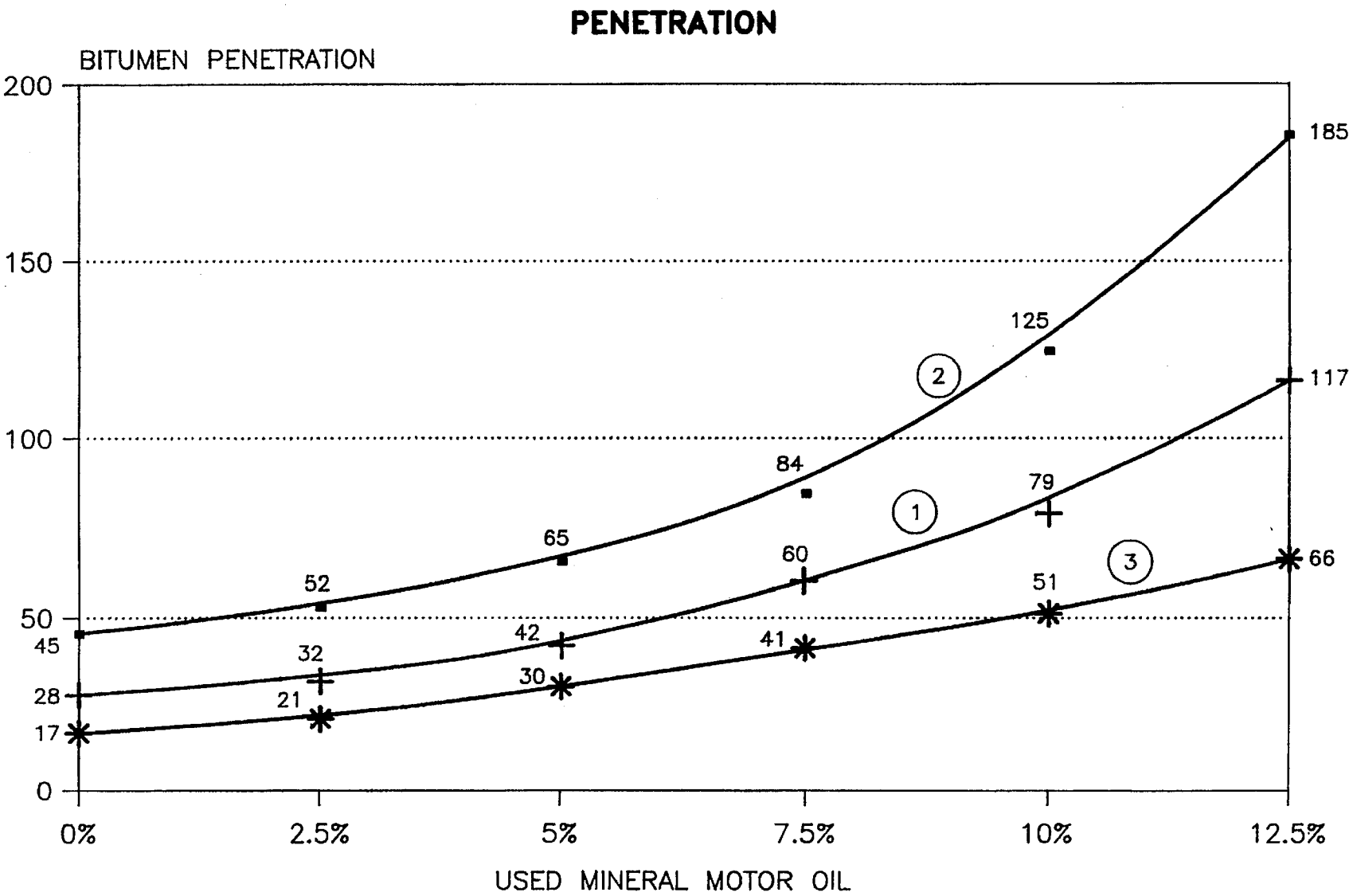
PENETRATION
BITUMEN PENETRATION
200
150
100
50
0
185
125
84
65
52
117
79
60
42
32
66
51
41
30
21
45
28
17
1
2
3
0%
2.5%
5%
7.5%
10%
12.5%
USED MINERAL MOTOR OIL

USED MINERAL MOTOR OIL ECOLOGICAL RECYCLING PROCEDURE

BACKGROUND OF THE INVENTION

The present invention, refers to a used mineral motor oil (U.M.M.O.) Ecological Recycling Procedure.

The applicant is the holder patent NQ ES P 8904172, having a used mineral motor oil recycling procedure as a main objective, comprising the following steps:

a) Filtration: According to the origin of the used mineral motor oil and its final destination, the used mineral motor oils are submitted to different degrees of filtration.

b) Dehumidification: According to their origin, the used mineral motor oils should be heat dried.

c) Distillation: According to their origin, the used mineral motor oils are distillated, in order to eliminate the most volatile components, they can contain.

d) Recycling process: The resulting used mineral motor oils, are recycled, in the general petroleum recycling plants or those plants using bitumen as a raw material. The above mentioned used mineral motor oils recycling process is carried out mainly in:

a) The main petroleum material inlet, in petroleum refining plants.

b) The raw material inlet, in the mineral oil distillation phase, in refining plants.

c) The bitumen distillation step, in refining plants.

d) The mixing process in bitumen production plants for road pavings, roof coverings, paints, emulsions or similar products.

In addition to the above-mentioned patent, the following patents also exist:

EP 421525 ENIMONT ANIC S.R.L.

Describing an EPM and EPDM copolymerization procedure and mentioning neither bitumen used mineral motor oil.

This patent does not anticipate the present invention.

EP 411627 HIMONT INC.

Describing a production process and the specifications of a taylor-made polymer for bitumen modification.

This patent does not anticipate the present invention.

ES 8706764 AUSIMONT s.p.a.

Describing a crosslinked polymeric bitumen mix using SBS and EVA. It uses aromatic oils and not paraffinic oils.

This patent does not anticipate the present invention.

ES 426382 and FR 2228817 SOCIETE NOUVELLE SIPLAST

Describing a polymeric mix using a solid solvent and thermoplastic dispersant and not using used mineral motor oils.

This patent does not anticipate the present invention.

DE 3446174 GIPRODORNNI

Describing a bituminous pavement regeneration procedure with out PCB's and PCT's detection and rejection phase. It regenerates an aged bitumen but it does not produce new bitumens or polymeric bitumens.

This patent does not anticipate the present invention.

DD 276505 and DD 276504 VEB HYDRIERW ZEITZ

Describing a bituminous pavement regeneration using oils with a different chemical composition to that of used mineral motor oils.

This patent does not anticipate the present invention.

EP 206015 and EP 300284 Marco FACHINI

Describing a mix using sulphuric depuration muds and APP (Atactic Polypropylene).

This patent does not anticipate the present invention.

EP 380384 SOCIETE DE PAVAGE ET DES ASPHALTES DE PARIS

Describing a bituminous mix made with heavy oils and polyolefin copolymers. It does not use either use mineral motor oil or paraffinic elastomer.

This patent does not anticipate the present invention.

EP 378371 W.R. GRACE & CO.-CONN.

Describing a bitumen mix made by using processed oils and SBS rubber. It does not use either use mineral motor oil or paraffinic elastomer.

This patent does not anticipate the present invention.

ES 8201192 and ES 8500979 VIAFRANCE

Describing vulcanized polymeric compositions using SBS rubber, EVA and aromatic oil.

This patent does not anticipate the present invention.

FR 2288127 SHELL B.V.

Describing blowing bitumen procedure.

This patent does not anticipate the present invention.

EP 422315 NYNÄS N.V.

Describing a vulcanizing process using fibers, heavy oils, preferably tar oils, blown bitumen. It does not use used mineral motor oils.

This patent does not anticipate the present invention.

SUMMARY OF THE INVENTION

Referring to all the above mentioned patents, and especially the patent ES P 8904172, there are two important issues relating to used mineral motor oils, one referring to environmental contamination and the second referring to the road paving application.

Concerning the first issue, environmental contamination, the procedure described in patent ES P 8904172, does not take into account that the used mineral motor oils can contain dangerous residues, some even cancer-causing and which are extremely contaminating. These dangerous residues can be present in the final product and can be harmful to the environment, human beings, animals and plants.

Three important aspects should be taken into account:

The first aspect is that the used mineral motor oils from electric transformers contain polychlorinated biphenyls PCB's and polychlorinated triphenyls PCT's, which are highly cancer-causing. The used mineral motor oils containing PCB's and PCT's cannot be treated according to the recycling procedure described in the present invention, because the final product would be carcinogenic. Therefore, the present invention includes a previous identification and selection phase for identifying the oils containing PCB's and PCT's, rejecting them from being used in the present invention.

The second aspect relates to used mineral motor oils which contain some extremely pollutant heavy metals, such as Cu, Cr, Pb, Ni, Zn, Ba and others. The presence, in the final product, of these heavy metals in higher percentages than those legally accepted can contaminate the environment, with a serious risk to all species. To avoid this heavy metal contamination risk, the present invention proposes mixing the used mineral motor oils into bitumen in such proportions so that the final mix does not transfer these heavy metals in a higher proportion than the legally specified to the environment, and preferably less than 0.1%.

The third aspect refers to the occasional presence of light hydrocarbons in used mineral motor oils, producing environment pollution during bitumen heating at 180° C. in bituminous pavement production and its application.

BRIEF DESCRIPTION OF DRAWINGS

FIG. 1 is a graph showing the penetration evolution of bitumen vs the amount of used mineral motor oil.

DESCRIPTION OF PREFERRED EMBODIMENTS

According to one aspect of, the present invention, an ecological recovering procedure is provided, preferably whereby used mineral motor oils comes from crankcases and the like, wherein there is no pollution of the environment by using them in bituminous road pavements, emulsions and paints.

In addition to the basic operations described in patent ES P 8904172, the present invention proposes treating the used mineral motor oils according to the following complementary operations:

1) Prior to filtering

The used mineral motor oils to be recycled are submitted to a selection operation, according to the following operations:

a) Detection of the used mineral motor oils containing the cancer-causing and highly pollutant PCB's and/or PCT's.

b) Separation and rejection of used mineral motor oils containing PCB's and/or PCT's from the recycling procedure.

2) Before the dehumidification operation, when the used mineral motor oils contain a high water proportion, this can be eliminated according to the following complementary operation:

1) Separation of the water contained in the used mineral motor oils, by decantation prior to the drying operation. If necessary, the separated water can be ultraspan to reduce its oil content under the legal specification.

3) Before the distillation operation, if necessary, the used mineral motor oils can be submitted to a thermal shock operation, based in increasing the oil temperature to 290° C. for approximately 15 to 20 minutes. This treatment makes separation of the inorganic products, easy in the next operation.

4) Heat cleaning process: When the used mineral motor oils contain a high amount of light hydrocarbons, these can be eliminated by heating the used mineral motor oils about 190° C., in order to separate and recuperate the light hydrocarbons. These light hydrocarbons can subsequently be re-used as hydrocarbon fuel. In the recycling process, the heavy metals, such as Cu, Cr, Pb, Ni, Zn, Ba and others, usually contained in the used mineral motor oils, are stabilized by mixing these used mineral motor oils with bitumen in such a way that the final mix does not transfer the heavy metals to the environment in a higher proportion than that legally established and accepted; consequently, the recycling process must be carried out according to the following principles:

A) In the recycling process, to be carried out in the refinery, the used mineral motor oils are mixed with the corresponding petroleum cut in such proportion that the bituminous road pavement produced using a bitumen coming from the corresponding vacuum residue, after being submitted to lixiviation operation, does not transfer the heavy metals in a higher amount than that legally established and accepted.

B) The used mineral motor oil and the bitumen cut mix, carried out in refinery or in the road paving production plant, is done by using a 1 to 15 percent of used mineral motor oil and, a minimum of 85 percent of bitumen. In some cases the proportion can be modified to a 1 to 25 percent of used mineral motor oil and a minimum of 75 percent of bitumen.

C) In the bituminous emulsion and bituminous paint production in the recycling process, the above mentioned mix is carried out by adding 0 to 20 percent of used mineral motor oil to a 100 to 80 percent of penetration bitumen.

According to the present invention, only penetration bitumens can be used, preferably with a penetration of less than or equal to 100⅒ of mm.

If necessary, the used mineral motor oils and the penetration bitumen mix is submitted to a hardening process by means of an oxidation process, either catalytic or not, in order to obtain the right penetration level.

The FIGURE shows the evolution of the final bitumen mix penetration, versus the different used mineral motor oil amounts added to the original bitumen.

EXAMPLE

Stabilisation of the Heavy Metal Contained in the used Mineral Motor Oil Mixed with a Penetration Bitumen (BITUMEN)

| | HEAVY METAL CONTENT in mg/Kg (ppm) | | |
|---|---|---|---|
| METAL | M.U.M.O. | BITUMEN + 15% U.M:M.O. | HEAVY METAL TRANSFER TO WASHING WATER |
| Ba | 24 | inf 20 | inf 0.1 |
| Cd | inf 20 | inf 20 | inf 0.1 |
| Cu | 31 | inf 20 | inf 0.1 |
| Cr | inf 20 | inf 20 | inf 0.1 |
| Fe | 90 | 0, 13% | inf 0.1 |
| Ni | inf 20 | 40 | inf 0.1 |
| Pb | 0, 13% | 85 | inf 0.5 |
| V | inf 20 | 112 | inf 0.1 |
| Zn | 586 | 48 | inf 0.1 |

TABLE

60–70 Penetration bitumen characteristics according to UNE 104 201-91 Vs. 40–50 bitumen + 5% of U.M:M.O. MIX

| CHARACTERISTICS | BITUMEN 60–70 | 40–50 + 5% of M.U.M.O. |
|---|---|---|
| DUCTILITY at 25° C. | Min 90 | 102 |
| COLD BENDING PLIABILITY | −8 | −11 |
| SOFTENING POINT | 48–57 | 48 |

The above table shows that the characteristics of the bitumen obtained according to the present invention by mixing 40–50 bitumen with 5% of used mineral motor oils, are coincident with the characteristics of 60–70 bitumen specified in UNE 104 201–91 standard.

The graph in the drawings shows the penetration evolution of 20–30 bitumen (curve 1), 40–50 bitumen (curve 2)

and 10–20 bitumen (curve 3) mixes Vs. the used mineral motor oil percentages added to those bitumen mixes.

Concerning the second question, road pavement application, in addition to the classic pavements, nowadays polymeric bitumen mixes exist, made of bitumen and thermoplastic rubbers, SBS type (styrene - butadiene - Styrene). These rubber bitumen pavements are specifically self-draining and their main application is like a wearing course for roads or motorways.

Due to the aromatic character of SBS rubbers, it is not possible to add used mineral motor oils to those self-draining mixes, because the paraffinic nature of the used mineral motor oils makes those polymeric bitumen mixes incompatible.

Consequently ecological elimination of the used mineral motor oils (UMMO) by adding these polymeric mixes made of SBS thermoplastic rubbers would be not possible.

To eliminate the above mentioned incompatibility and continue to eliminate the used mineral motor oils ecologically, the present invention proposes using paraffinic thermoplastic rubbers instead of the above mentioned SBS rubber.

Consequently, the present invention proposes to make a bituminous mix having as its main components: bitumen, used mineral motor oils and paraffinic rubber. This mix being useful for road paving and completely stabilizing the heavy metals contained in the used mineral motor oils.

According to the present invention the bitumen and used mineral motor oils are mixed before adding the thermoplastic rubber.

The bituminous pavement obtained following the present invention can be self-draining or open pore by using open granulometry arids. The self-draining pavements, obtained according to the present invention, have high mechanical properties and create empty spaces between the arid particles, allowing the water to drain and flow throughout the pavement mass, significantly improving the adherence of car tires to the road surface, specially in rainy countries.

The polymeric bitumen pavements, obtained according the present invention, can be either compact or not (self-draining), and due to their high cohesion and mechanical properties can be formulated reducing the total amount of bitumen.

Preferably, the paraffinic elastomers used for this invention are one of the following types: EPM (Ethylene - Propylene copolymer), EPDM ( Ethylene - Propylene - Diene monomer) and butyl rubber.

The above mentioned components mix is carried out by stirring using cutting and/or shearing, and heating the mix components preferably at a temperature between 150° C. and 200° C.

According to the present invention, during or after the mix of the three main components, a paraffinic plastic, preferably polyethylene, can be added in order to modify the thermal and/or mechanical properties of the final polymeric bitumen mix.

The present invention considers the possibility of using different types of penetration bitumens, but with the final bitumen mix penetration equal or lower than 100⁄10 of mm.

According to the present invention, the used mineral motor oils and the bitumen cut mix, carried out in the refinery or in road pavement production plant, is done by using 1 to 15 percent used mineral motor oils and a minimum of 85 percent bitumen. In some cases the proportion can be modified from 1 to 25 percent used mineral motor oils and a minimum of 75 percent bitumen.

Also, according to the present invention, it is not necessary to carry out this polymer paraffinic bitumen mix using large equipment, like the SBS bituminous pavement mixes, as it can be done in small production plants.

We claim:

1. In a process for recycling of used mineral oil wherein used mineral oils are filtered, dehumidified, distilled, and recycled, the improvement comprising the steps of:

(a) prior to filtering used mineral oils, detecting the presence of polychlorinated biphenyls and polychlorinated triphenyls in used mineral oils;

(b) separating out and discarding used mineral oils containing at least one of the polychlorinated biphenyls and polychlorinated triphenyls so as to obtain used mineral oil substantially free of the polychlorinated biphenyls and polychlorinated triphenyls; and (c) recycling used mineral oils which are substantially free of polychlorinated biphenyls and polychlorinated triphenyls by mixing the used mineral oils with bitumen such that heavy metals present in the used mineral oil bitumen mix are stabilized.

2. The process of claim 1 further comprising the step of: prior to distilling used mineral oils which are substantially free of polychlorinated biphenyls and polychlorinated triphenyls, submitting used mineral oils to thermal shock operation.

3. The process of claim 1 further comprising, when used mineral oils contain water and light hydrocarbons;

separating water from used mineral oils by decantation wherein said water separated from the used mineral oil can be ultracentrifuged to reduce the amount of oil present; and distilling of used mineral oils at 190° C. to eliminate light hydrocarbons.

4. The process of claim 1 wherein distillation bitumens are mixed with the used mineral oils and have final penetrations of less than 100⁄10 of mm.

5. The process of claim 1 further comprising oxidation hardening of the bitumen mix.

6. In a process for recycling used mineral oil wherein used mineral oils are filtered, dehumidified, distilled and recycled, the improvement comprising the steps of:

(a) prior to filtering used mineral oils, detecting the presence of polychlorinated biphenyls and polychlorinated triphenyls in used mineral oils;

(b) separating out and discarding used mineral oils containing at least one of the polychlorinated biphenyls and polychlorinated triphenyls so as to obtain used mineral oil substantially free of the polychlorinated biphenyls and polychlorinated triphenyls;

(c) recycling used mineral oils which are substantially free of polychlorinated biphenyls and polychlorinated triphenyls by mixing the used mineral oils with bitumen and paraffinic thermoplastic rubber such that heavy metals present in the used mineral oil bitumen mix are stabilized.

7. The process of claim 6 further comprising the step of: prior to distilling used mineral oils which are substantially free of polychlorinated biphenyls and polychlorinated triphenyls, submitting used mineral oils to thermal shock operation.

8. The process of claim 6 further comprising, when the used mineral oils contain water and light hydrocarbons;

separating water from used mineral oils by decantation wherein said water separated from the used mineral oil can be ultracentrifuged to reduce the amount of oil present; and distilling of used mineral oils at 190° C. to eliminate light hydrocarbons.

9. The process of claim 6 wherein distillation bitumens are mixed with the used mineral oils, having final penetrations of less than 100⅒ of mm.

10. The process of claim 6 further comprising oxidation hardening of the bitumen mix.

11. The process of claim 6 wherein the used mineral oil and bitumen are mixed prior to mixing with the paraffin rubber.

12. The process of claim 6 wherein the paraffin rubbers are selected from the group consisting of ethylene propylene monomer, ethylene propylene diene monomer and butyl rubber.

13. The process of claim 6 further comprising adding a paraffinic plastic to the polymeric bitumen mix for modifying at least one of the thermal and mechanical properties of the mix.

14. The process of claim 6 wherein self draining pavements are made.

15. The process of claim 6 wherein compact bitumous pavements are made by reducing the amount of distillation bitumen polymeric mix.

16. The process of claim 6 further comprising stirring the polymeric mix and heating the mix to a temperature of between 150°–200° C.

17. The process of claim 6 wherein a final distilled bitumen having a penetration of less than 100⅒ of mm is obtained.

18. The process of claim 6 wherein the amount of used mineral oil comprises between 1–15% by weight of the mix and the amount of bitumen comprises at least 85% by weight of the mix.

* * * * *